US010617160B2

(12) United States Patent
Spruill et al.

(10) Patent No.: US 10,617,160 B2
(45) Date of Patent: Apr. 14, 2020

(54) ATHLETIC COMPRESSION FIT PANTS/SHORTS WITH GUSSETS, CUT-RESISTANT FABRIC, AND PROTECTIVE PADS

(71) Applicants: Gary Rayford Spruill, Enid, OK (US); Douglas Verne Thom, Langley (CA)

(72) Inventors: Gary Rayford Spruill, Enid, OK (US); Douglas Verne Thom, Langley (CA)

( * ) Notice: Subject to any disclaimer, the term of this patent is extended or adjusted under 35 U.S.C. 154(b) by 304 days.

(21) Appl. No.: 14/065,680

(22) Filed: Oct. 29, 2013

(65) Prior Publication Data

US 2014/0115747 A1 May 1, 2014

Related U.S. Application Data

(60) Provisional application No. 61/796,043, filed on Nov. 1, 2012.

(51) Int. Cl.
*A41D 13/00* (2006.01)
*A41D 13/05* (2006.01)

(52) U.S. Cl.
CPC ..... *A41D 13/0543* (2013.01); *A41D 13/0015* (2013.01)

(58) Field of Classification Search
CPC ..... A41D 1/088; A41D 13/05; A41D 13/130015; A41D 13/0543; A41D 13/0015
USPC ..... 2/270, 267, 466
See application file for complete search history.

(56) References Cited

U.S. PATENT DOCUMENTS

| | | | | | |
|---|---|---|---|---|---|
| 4,035,844 | A * | 7/1977 | Atack | A41D 1/08 | 2/22 |
| 5,201,074 | A * | 4/1993 | Dicker | A41D 13/0015 | 2/227 |
| 5,263,923 | A * | 11/1993 | Fujimoto | A41D 13/0015 | 602/62 |
| 5,729,832 | A * | 3/1998 | Grilliot | A41D 13/00 | 2/2.5 |
| 7,707,658 | B2 * | 5/2010 | Culhane | A41D 1/067 | 2/227 |
| 8,214,926 | B2 * | 7/2012 | Brown | A61F 5/0104 | 2/228 |
| 2004/0255358 | A1 * | 12/2004 | Ota | A41D 13/0015 | 2/69 |
| 2005/0204458 | A1 * | 9/2005 | Wong | A41B 9/02 | 2/466 |
| 2005/0229282 | A1 * | 10/2005 | Davis | A41D 13/0575 | 2/69 |
| 2006/0169004 | A1 * | 8/2006 | Belluye | A41D 1/084 | 66/177 |
| 2008/0040831 | A1 * | 2/2008 | Nilforushan | A41D 13/0058 | 2/69 |
| 2009/0025115 | A1 * | 1/2009 | Duffy | A41D 13/0015 | 2/69 |

(Continued)

*Primary Examiner* — Timothy K Trieu
(74) *Attorney, Agent, or Firm* — Hall Estill Attorneys at Law

(57) ABSTRACT

An athletic compression fit pants/shorts with gussets constructed out of moisture-wicking, high-performance fabrics with varying elasticities, cut-resistant fabrics, and protective pads. Each of the gussets have a function and targets specific leg muscles to provide a desired benefit in the overall performance of the present invention. The gussets are named: 1.) Quadriceps gusset; 2.) Sartorius and Abductor Magnus gusset; 3.) Gluteus Medius gusset; 4.) Gluteus Maximus and Hamstring gusset.

20 Claims, 8 Drawing Sheets

(56) References Cited

U.S. PATENT DOCUMENTS

| | | | | |
|---|---|---|---|---|
| 2010/0024101 | A1* | 2/2010 | Berner, Jr. | A41D 13/0015 2/455 |
| 2010/0024105 | A1* | 2/2010 | Sims | A63B 71/1216 2/466 |
| 2011/0016610 | A1 | 1/2011 | Wieder | |
| 2013/0061377 | A1* | 3/2013 | Wyner | A41D 13/015 2/455 |
| 2014/0259250 | A1* | 9/2014 | Strum | F41H 1/02 2/2.5 |
| 2014/0283282 | A1 | 9/2014 | Dye et al. | |
| 2015/0052654 | A1 | 2/2015 | Thom | |
| 2015/0272256 | A1 | 10/2015 | Meier | |

* cited by examiner

ATHLETIC COMPRESSION FIT PANTS/SHORTS WITH GUSSETS, CUT-RESISTANT FABRIC, AND PROTECTIVE PADS

RELATED APPLICATIONS

The present application makes a claim of domestic priority under 35 U.S.C. 119(e) to U.S. Provisional Patent Application No. 61/796,043 filed Nov. 1, 2012.

FIELD OF THE INVENTION

The field of the invention relates to compression fit pants/shorts, and more particularly to compression fit pants or shorts with gussets, cut-resistant fabric, and protective pads.

BACKGROUND OF THE INVENTION

Compression fit pants/shorts are known in the prior art constructed out of stretch fabric, (i.e., spandex, Lycra®, etc.), wherein compression is applied, in general, to the overall torso with no specific muscle groups being targeted to benefit from the compression fit.

SUMMARY OF THE INVENTION

The present invention, compression fit pants/shorts with gussets, is new and unknown in the prior art due to the compression fit shorts/pants targets specific muscle groups in lower torso (i.e., buttocks and legs). Wherein, the compression fit pants/shorts with gussets are constructed out of moisture-wicking, high-performance stretchable fabric. And, wherein, specific gussets, within the present invention, can be constructed out of stretchable fabric with varying or different elasticity to provide extra compression or isolate certain muscle groups requiring attention (e.g., the gussets for the quadriceps may be constructed out of stretchable fabric with greater elasticity than is in the stretchable fabric for the gussets of the gluteus medius).

In the present invention, compression fit pants/shorts with gussets have a pair of four gussets. Both pairs of gussets include: 1.) a Quadriceps gusset; 2.) a Sartorius and Abductor Magnus gusset; 3.) a Gluteus Medius gusset; 4.) a Gluteus Maximus and Hamstring gusset. Each gusset has a specific function in the overall performance of the pants/shorts. And, each pair of gussets are named in accordance with a particular group of muscles for which it provides benefits. Each pair of the different gussets in the present invention are constructed out of moisture-wicking, high-performance fabric with varying elasticity allowing the wearer to select pants/shorts which isolates specific muscles that may need greater compression due to possible injuries, weakness, etc. Cut-resistant fabrics such as Kevlar® (poly-paraphenylene terephthalamide) or SteelSkin™ (a proprietary anti-abrasion fabric), the latter of which is manufactured and proprietary to Garmatex Technologies (Unit 101, 2455-192nd Street, Surrey, B.C., Canada, V3S 3X1, and 2124 Mendocino Street, Fullerton, Calif., 92831, USA) can be used in the different pairs of gussets in addition to fabric of varying elasticity being used in adjoining gussets of the present invention.

Those cut-resistant fabrics can be used in the knees, Gluteus Medius gussets, crotch, and calves to facilitate endurance and protect the athlete or wearer. Removable protective pads can be inserted in a pocket on the inside of the Gluteus Medius gussets of the compression fit pants/shorts. The pads can be constructed out of the following: articulated, thermal formed high-density foam; ethylene vinyl acetate (EVA); ethylene vinyl acetate foam; or other known non-toxic, odorless lightweight materials. The Gluteus Medius gussets can also be constructed out of a stretchable, cut-resistant fabric. The fabric used in the construction of this invention can incorporate a 100% all natural, anti-microbial treatment that reduces odor and fungus build up. And, such treated fabrics have been shown to control the bacteria *Staphylococcus aureus* which causes staph infections.

BRIEF DESCRIPTION OF THE DRAWINGS

The gussets of the invention will be described in more detail with reference to the accompanying drawings which illustrate a specific embodiment of the pants or shorts of the present invention.

DETAILED DESCRIPTION

Figure 1:
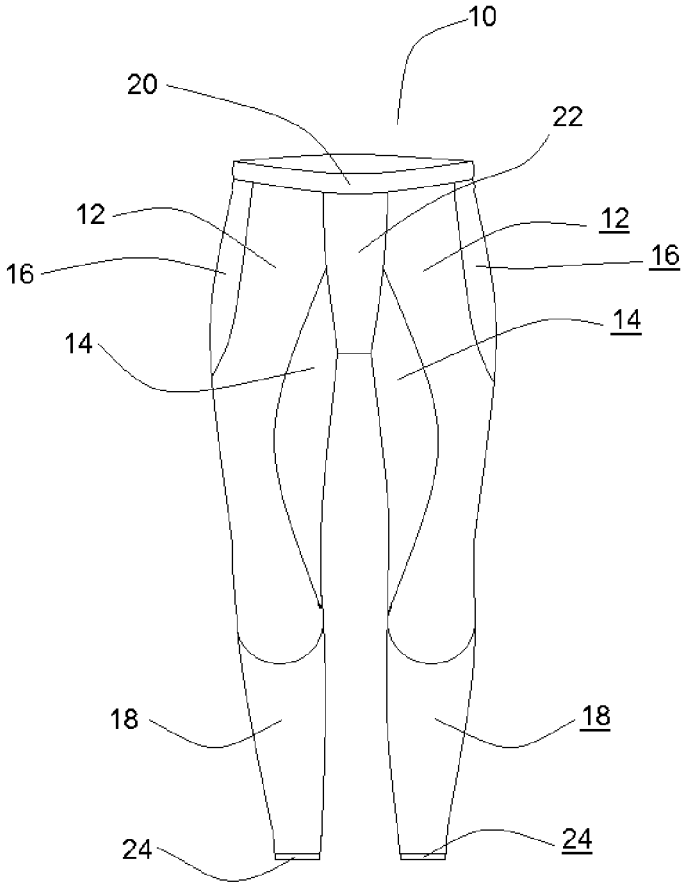
FIG. 1 illustrates the preferred frontal view of the compression fit pants of the present invention.

With reference to the accompanying drawings the same parts are identified by the same reference numerals in all figures of the drawings.

In FIG. 1, a specific embodiment, frontal view of the present invention is illustrated. Wherein, the compression fit pants with gussets of the present invention is generally indicated by numeral 10. Numerals 12, 12, 14, 14, and 16, 16 indicate gussets. The Quadriceps gussets are indicated by Numerals 12, 12. The Sartorius and Abductor Magnus gussets are indicated by Numerals 14, 14. The Gluteus Medius gussets are indicated by Numerals 16, 16. The calves portions of the compression fit pants are indicated by Numerals 18, 18. The waistband is indicated by Numeral 20. The crotch is indicated by Numeral 22. The hems for the compression fit pants are indicated by Numerals 24, 24.

Figure 2:
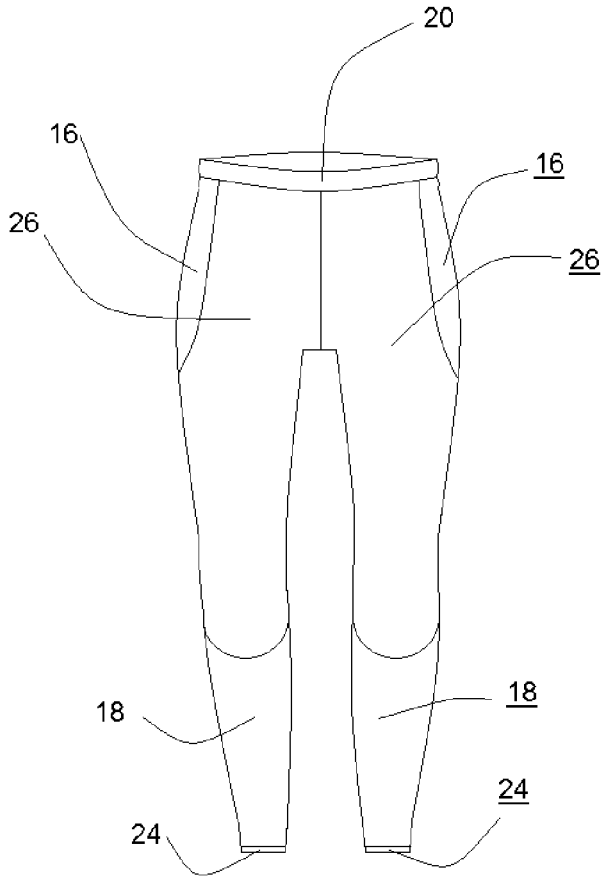
FIG. 2 illustrates the preferred back view of the compression fit pants of the present invention.

In FIG. 2 a specific embodiment, back view, of the present invention is illustrated of the compression fit pants with gussets of the present invention. The Gluteus Maximus and Hamstring gussets are indicated by Numerals 26, 26. The waistband is indicated by Numeral 20. The Gluteus Medius gussets are indicated by Numerals 16, 16. The calves portions of the compression fit pants are indicated by Numerals 18, 18. The hems for the compression fit pants are indicated by Numerals 24, 24.

Figure 3:
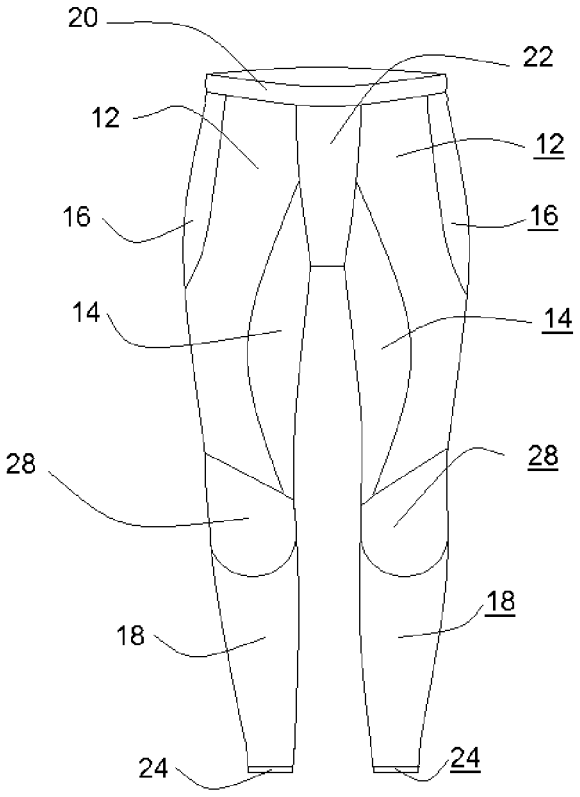
FIG. 3 illustrates a frontal view of the compression fit pants of the present invention, wherein cut-resistant fabric is used in the knees and the Gluteus Medius gussets.

FIG. 3 illustrates cut-resistant fabric 28, 28 disposed in the knee sections of the Quadriceps gussets 12, 12.

Figure 4:
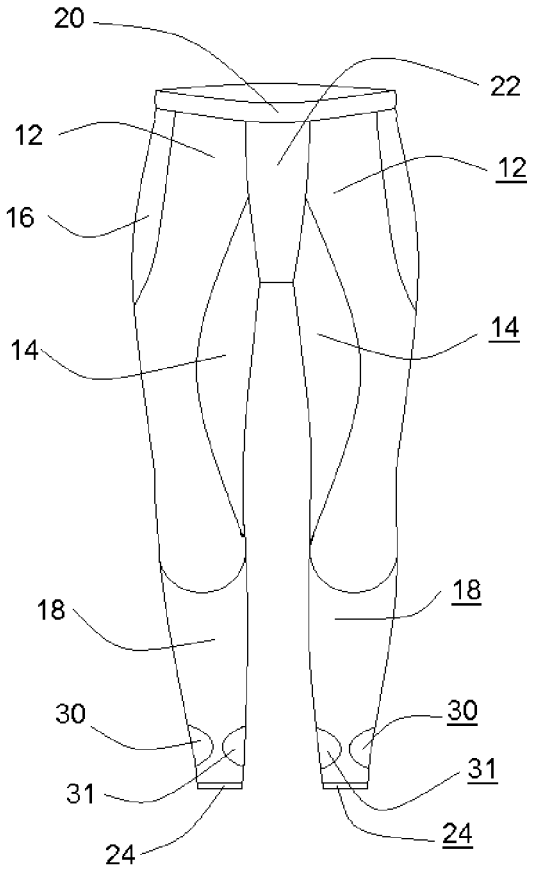
FIG. 4 illustrates a frontal view of the compression fit pants of the present invention, wherein cut-resistant fabric is used in the shins region proximal the ankles.

FIG. 4 illustrates cut-resistant fabric 28, 28 disposed in the shin sections of the calves 18, 18.

Figure 5:
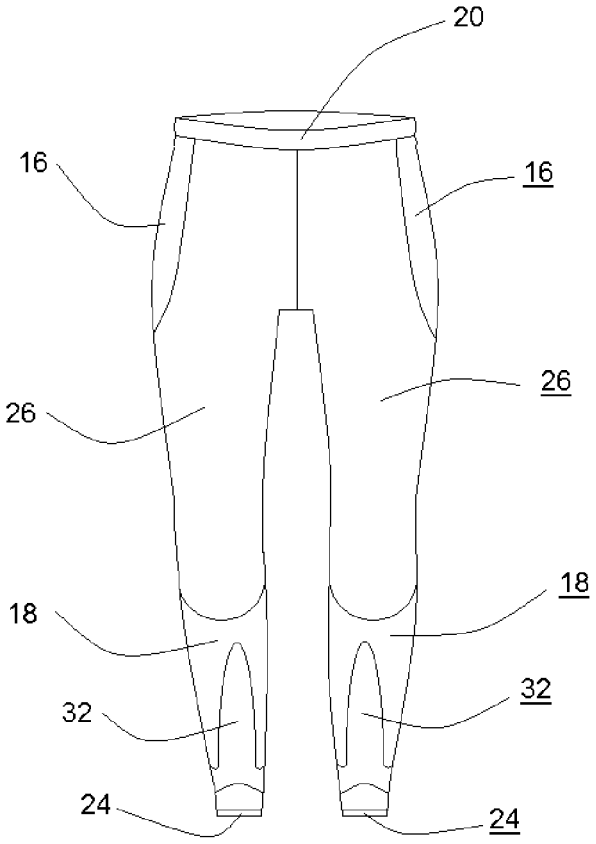
FIG. 5 illustrates a back view of the compression fit pants of the present invention, wherein cut-resistant fabric is used in the lower calves regions proximal to the ankles.

FIG. 5 illustrates cut-resistant fabric 28, 28 disposed in the calve sections of the calves 18, 18.

Figure 6:
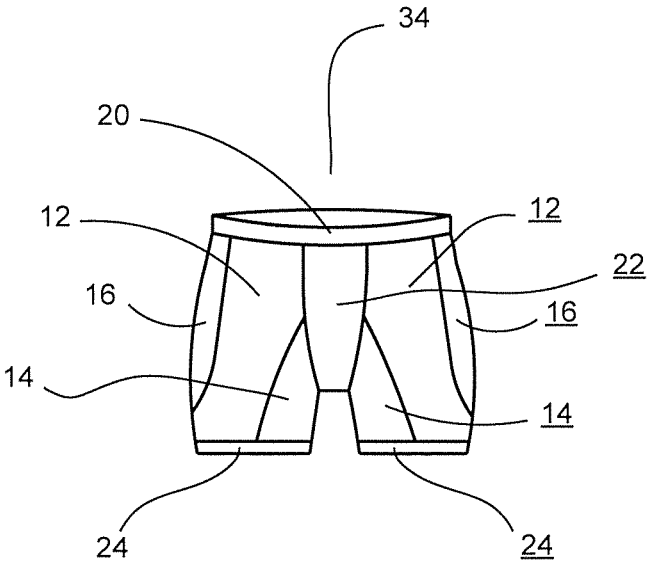
FIG. 6 illustrates the preferred, frontal view of the compression fit shorts of the present invention.

FIG. 6 illustrates a frontal view of the compression fit shorts with gussets of the present invention indicated by numeral 34. The gussets indicated by numerals 12, 12, 14, 14, and 16, 16 are identical to the gussets in FIG. 1 only shortened. The hems are indicated by numerals 24, 24. The waistband 20 is identical to FIGS. 1 and 2. The crotch 22 is identical to crotch 22 in FIG. 1.

Figure 7:
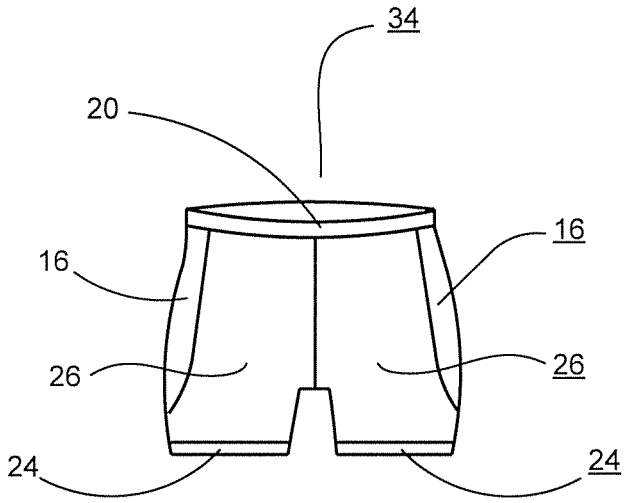
FIG. 7 illustrates the preferred, back view of the compression fit shorts of the present invention.

FIG. 7 illustrates a back view of the compression fit shorts with gussets of the present invention indicated by numeral 34. The gussets indicated by numerals 16, 16, 26, 26 are identical to the gussets in FIG. 2 only shortened. The hems 24, 24 are identical to the hems 24, 24 in FIGS. 1 and 2. The waistband 20 is identical to the waistband 20 in FIGS. 1 and 2.

Figure 8:
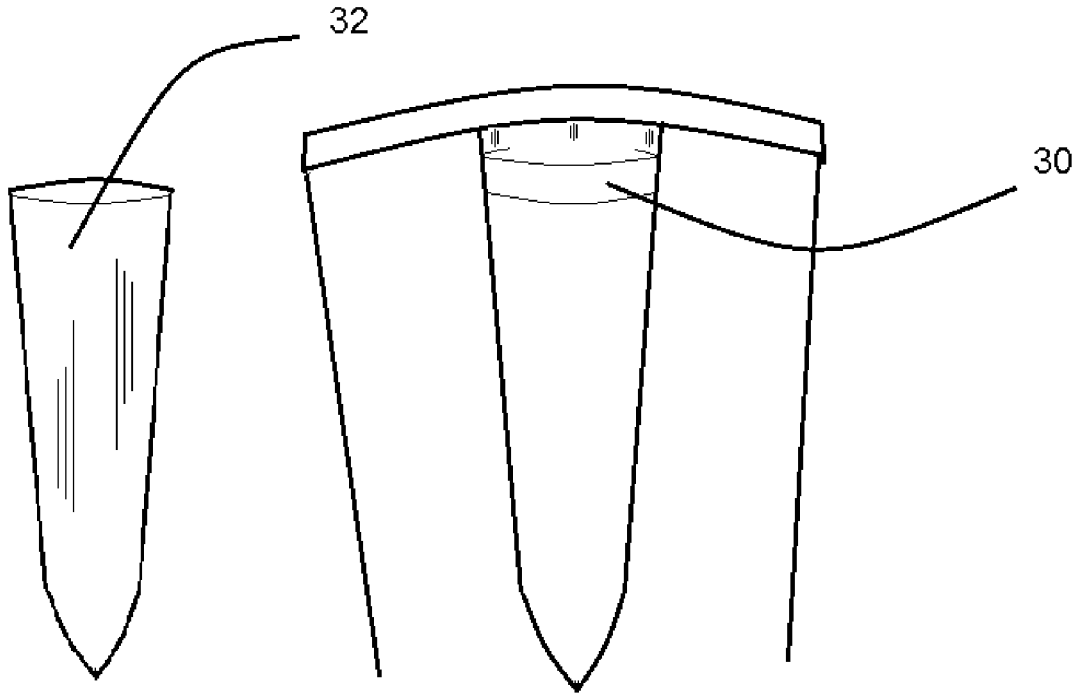
FIG. 8 illustrates the inside of the compression fit pants or shorts. Specifically, the Gluteus Medius gusset pocket where a removable protective pad is inserted.

FIG. 8 illustrates a pocket 30 sewn on the inside of the Gluteus Medius gusset 16 for a removable hip pad 32. The Gluteus Medius gusset 16, not illustrated in FIG. 8, has an identical pocket sewn on its inside for an identical removable hip pad.

Accordingly, some embodiments can be viewed as athletic pants comprising a waist band, a crotch, an identical pair of four gussets, a calves and shins portion, and a pair of removable protective pads.

The waistband can be constructed out of elastic or an elastic and draw-string combination. The crotch can be constructed out of moisture-wicking, high-performance stretchable fabrics of varying elasticities. The crotch can be constructed out of a cut-resistant fabric.

The identical pair of four gussets can include a Quadriceps gusset, a Sartorius and Abductor Magnus gusset, a Gluteus Medius gusset and a Gluteus Maximus and Hamstring gusset. Each of the gussets can be constructed out of moisture-wicking, high-performance stretchable fabric. The gussets can be formed of the same fabric, or from different fabrics having different elasticities. A pocket can be sown on the interior side of the Gluteus Medius gusset to accommodate a removable hip pad.

The removable protective pads can be constructed of articulated, thermal formed high-density foam, ethylene vinyl acetate (EVA), EVA foam, or other known non-toxic, odorless and lightweight materials.

The calves and shins portion of the athletic pants can be constructed out of moisture-wicking, high-performance stretchable fabric. The calves and shins portion can further be provided with a cut-resistant fabric as an overlay on the exterior side or as an inner-lay on the interior side of the moisture-wicking, high-performance stretchable fabric.

The gussets can be of a length suitable for long or short pants (shorts). The fabric used in the construction of the pants can incorporate a 100% all natural anti-microbial treatment that reduces odor and fungus build up.

Without limitation, in some embodiments a compression fit garment (such as 10) is configured to be worn over the lower torso of a human, comprising a waistband (such as 20) configured to encircle, when worn by the human, a waist portion of the lower torso of the human; a first gusset (such as 12) coupled to the waistband and configured with a first shape adapted to cover, when worn by the human, a first muscle group of the lower torso of the human, the first gusset comprising a stretchable compression fabric (such as spandex) having a first elasticity selected to apply a first compression fit to the first muscle group to isolate the first muscle group; a second gusset (such as 14) coupled to the first gusset and configured with a different, second shape adapted to cover, when worn by the human, a different, second muscle group of the lower torso of the human, the second gusset comprising a stretchable compression fabric having a different, second elasticity selected to apply a different, second compression fit to the second muscle group to isolate the second muscle group; and a portion of cut-resistant fabric (such as 28) attached to and covering a first portion of an exterior surface of a selected one of the first gusset or the second gusset (see e.g., FIG. 3) so that a remaining second portion of the exterior surface of the selected one of the first gusset or the second gusset is not covered by the portion of cut-resistant fabric, the cut-resistant fabric formed of a different material (e.g., Kevlar®) than the selected one of the first gusset or the second gusset (e.g., spandex).

In further embodiments, the compression fit garment can further include a third gusset (such as 16) coupled to the second gusset and configured with a different, third shape adapted to cover, when worn by the human, a different, third muscle group of the lower torso of the human, the third gusset comprising a stretchable compression fabric having a different, third elasticity selected to apply a different, third compression fit to the third muscle group to isolate the third muscle group; and a fourth gusset (such as 18) coupled to the third gusset and configured with a different, fourth shape adapted to cover, when worn by the human, a different, fourth muscle group of the lower torso of the human, the fourth gusset comprising a stretchable compression fabric having a different, fourth elasticity selected to apply a different, fourth compression fit to the fourth muscle group.

In further embodiments, the compressive fit garment can include a layer of fabric attached to an interior surface of the selected one of the first gusset or the second gusset to form an interior pocket (such as 30 in FIG. 8), and a removable pad (such as 32) disposed within the interior pocket.

We claim:

1. A compression fit garment configured to be worn over the lower torso of a human, comprising:

a waistband configured to encircle, when worn by the human, a waist portion of the lower torso of the human;

a first gusset coupled to the waistband and configured with a first shape adapted to cover, when worn by the human, a first muscle group of the lower torso of the human, the first gusset comprising a stretchable compression fabric having a first elasticity selected to apply a first compression fit to the first muscle group to isolate the first muscle group;

a second gusset coupled to the first gusset and configured with a different, second shape adapted to cover, when worn by the human, a different, second muscle group of the lower torso of the human, the second gusset comprising a stretchable compression fabric having a different, second elasticity selected to apply a different, second compression fit to the second muscle group to isolate the second muscle group; and a portion of cut-resistant fabric attached to and covering a first portion of an exterior surface of a selected one of the first gusset or the second gusset so that a remaining second portion of the exterior surface of the selected one of the first gusset or the second gusset is not covered by the portion of cut-resistant fabric, the cut-resistant fabric formed of a different material than the selected one of the first gusset or the second gusset.

2. The compression fit garment of claim 1, further comprising:

a third gusset coupled to the second gusset and configured with a different, third shape adapted to cover, when worn by the human, a different, third muscle group of the lower torso of the human, the third gusset comprising a stretchable compression fabric having a different, third elasticity selected to apply a different, third compression fit to the third muscle group to isolate the third muscle group;

a fourth gusset coupled to the third gusset and configured with a different, fourth shape adapted to cover, when worn by the human, a different, fourth muscle group of the lower torso of the human, the fourth gusset comprising a stretchable compression fabric having a different, fourth elasticity selected to apply a different, fourth compression fit to the fourth muscle group.

3. The compressive fit garment of claim 2, wherein each of the first, second, third and fourth muscle groups corresponds to a different one of a Quadriceps muscle group of the lower torso of the human, a Sartorius and Abductor Magnus muscle group of the lower torso of the human, a Gluteus Medius muscle group of the lower torso of the human, or a Gluteus Maximus and Hamstring muscle group of the human.

4. The compressive fit garment of claim 1, wherein the selected one of the first gusset or the second gusset is adapted to cover, when worn by the human, a Quadraceps muscle group of the lower torso of the human, and the portion of cut-resistant fabric is adapted to cover, when worn by the human, a knee section of the lower torso of the human.

5. The compressive fit garment of claim 1, wherein the selected one of the first gusset or the second gusset is adapted to cover, when worn by the human, a Gluteus medius muscle group of the lower torso of the human, and the portion of cut-resistant fabric is adapted to cover, when worn by the human, a hip section of the lower torso of the human.

6. The compressive fit garment of claim 5, further comprising a layer of fabric attached to an interior surface of the selected one of the first gusset or the second gusset to form an interior pocket, and a removable pad disposed within the interior pocket.

7. The compressive fit garment of claim 1, further comprising a crotch portion of a stretchable compression fabric having a third shape adapted to cover, when worn by the human, a crotch section of the lower torso of the human.

8. The compressive fit garment of claim 1, further comprising a calve portion of a stretchable compression fabric having a third shape adapted to cover, when worn by the human, a calve section of the lower torso of the human.

9. The compressive fit garment of claim 8, further comprising a second portion of cut-resistant fabric attached to the calve portion.

10. The compressive fit garment of claim 8, wherein the second portion of cut-resistant fabric is adapted to cover, when worn by the human, a shin section of the lower torso of the human.

11. The compressive fit garment of claim 8, wherein the second portion of cut-resistant fabric is adapted to cover, when worn by the human, a calve portion of the lower torso of the human.

12. The compressive fit garment of claim 1, wherein the first and second gussets cover respective portions of a first leg of the lower torso of the human, and the compressive fit garment further comprises a third gusset nominally identical to and arranged in mirrored relation to the first gusset and a fourth gusset nominally identical to and arranged in mirrored relation to the second gusset, the third and fourth gussets covering respective portions of a different second leg of the lower torso of the human.

13. The compressive fit garment of claim 1, characterized as a pair of compressive fit athletic pants or a pair of compressive fit athletic shorts.

14. A compressive fit garment configured to be worn over the lower torso of a human, comprising:

a waistband configured to cover, when worn by the human, a waist portion of the lower torso of the human;

a first gusset coupled to the waistband and configured with a first shape adapted to cover, when worn by the human, a Quadraceps muscle group of the lower torso of the human, the first gusset comprising a stretchable compression fabric having a first elasticity to apply a first compression fit to the Quadraceps muscle group;

a second gusset coupled to the first gusset and configured with a different, second shape adapted to cover, when worn by the human, a Sartorius and Abductor Magnus muscle group of the lower torso of the human, the second gusset comprising a stretchable compression fabric having a different, second elasticity to apply a different, second compression fit to the Sartorius and Abductor Magnus muscle group;

a third gusset coupled to the second gusset and configured with a different, third shape adapted to cover, when worn by the human, a Gluteus Medius muscle group of the lower torso of the human, the third gusset comprising a stretchable compression fabric having a different, third elasticity to apply a different, third compression fit to the Gluteus Medius muscle group;

a fourth gusset coupled to the third gusset and configured with a different, fourth shape adapted to cover, when worn by the human, a Gluteus Maximus and Hamstring muscle group of the lower torso of the human, the fourth gusset comprising a stretchable compression fabric having a different, fourth elasticity to apply a different, fourth compression fit to the Gluteus Maximus and Hamstring muscle group; and a portion of cut-resistant fabric attached to and covering a first portion of an exterior surface of a selected one of the first, second, third or fourth gussets so that a remaining second portion of the exterior surface of the selected one of the first, second, third or fourth gussets is not covered by the portion of cut-resistant fabric, the selected one of the first, second third or fourth gussets formed of a first material, the portion of cut-resistant fabric formed from a different, second material.

15. The compressive fit garment of claim 14, wherein the selected one of the first, second, third or fourth gusset comprises spandex, and the portion of cut-resistant fabric comprises poly-paraphenylene terephthalamide.

16. The compression fit garment of claim 1, wherein the selected one of the first or second gusset comprises spandex, and the portion of cut-resistant fabric comprises poly-paraphenylene terephthalamide.

17. The compression fit garment of claim 15, further comprising a layer of fabric attached to an interior surface of the third gusset to form an interior pocket, and a removable pad disposed within the interior pocket.

18. The compressive fit garment of claim 15, further comprising:

a crotch portion of a stretchable compression fabric having a selected shape adapted to cover, when worn by the human, a crotch section of the lower torso of the human;

a calve portion of a stretchable compression fabric having a third shape adapted to cover, when worn by the human, a calve section of the lower torso of the human; and a portion of cut-resistant fabric attached to an exterior surface of the calve portion.

19. The compressive fit garment of claim 15, wherein the first elasticity is greater than the third elasticity.

20. The compressive fit garment of claim 15, wherein the first, second third and fourth gussets are adapted to cover, when worn by the human, a first leg of the lower torso of the human, and wherein the compressive fit garment further comprises a fifth gusset nominally identical to the first gusset, a sixth gusset nominally identical to the second gusset, a seventh gusset nominally identical to the third gusset and an eighth gusset nominally identical to the fourth gusset, the fifth, sixth, seventh and eighth gussets adapted to cover, when worn by the human, a second leg of the lower torso of the human.

* * * * *